US006202463B1

(12) United States Patent
Yorifuji et al.

(10) Patent No.: US 6,202,463 B1
(45) Date of Patent: Mar. 20, 2001

(54) PLUG AND MANDREL BAR FOR SEAMLESS STEEL PIPE ROLLING OPERATION FOR MANUFACTURING SEAMLESS STEEL PIPE

(75) Inventors: Akira Yorifuji; Takaaki Toyooka; Taro Kanayama, all of Handa (JP)

(73) Assignee: Kawasaki Steel Corporation, Kobe (JP)

( * ) Notice: Subject to any disclaimer, the term of this patent is extended or adjusted under 35 U.S.C. 154(b) by 0 days.

(21) Appl. No.: 09/214,935

(22) PCT Filed: Dec. 22, 1997

(86) PCT No.: PCT/JP97/04741

§ 371 Date: Jan. 15, 1999

§ 102(e) Date: Jan. 15, 1999

(87) PCT Pub. No.: WO98/29204

PCT Pub. Date: Jul. 9, 1998

(30) Foreign Application Priority Data

Dec. 27, 1996 (JP) ..... 8-349228

(51) Int. Cl.[7] ..... B21B 17/10; B21B 19/04
(52) U.S. Cl. ..... 72/209; 72/97
(58) Field of Search ..... 72/209, 97, 96, 72/95, 208

(56) References Cited

U.S. PATENT DOCUMENTS 5,031,434 * 7/1991 Takase et al. ..... 72/209

FOREIGN PATENT DOCUMENTS

| | | |
|---|---|---|
| 51-133167 | 11/1976 | (JP) . |
| 60-137511 | 7/1985 | (JP) . |
| 60-159156 | 8/1985 | (JP) . |
| 60-30964 | 9/1985 | (JP) . |
| 60-208458 | 10/1985 | (JP) . |
| 62-170479 | 7/1987 | (JP) . |
| 62-238011 | 10/1987 | (JP) . |
| 62-244505 | 10/1987 | (JP) . |
| 63-203205 | 8/1988 | (JP) . |
| 1-180712 | 7/1989 | (JP) . |
| 2-156037 | 6/1990 | (JP) . |
| 2-268909 | 11/1990 | (JP) . |
| 3-165904 | 7/1991 | (JP) . |
| 5-138213 | 6/1993 | (JP) . |
| 5-85242 | 12/1993 | (JP) . |

* cited by examiner

*Primary Examiner*—Rodney A. Butler
(74) *Attorney, Agent, or Firm*—Oliff & Berridge, PLC

(57) ABSTRACT

This invention provide a plug and a mandrel bar for use in rolling a seamless steel pipe of which life can be substantially improved more than that of the prior art under a severe condition of use always exposed to a high temperature and high load. The entire plug or the mandrel bar or at least the surface layer of the extremity end and the work section of it is made of ceramics. In addition, this invention provides a method for manufacturing a seamless steel pipe using such a plug or mandrel bar as described above.

7 Claims, 6 Drawing Sheets

PLUG AND MANDREL BAR FOR SEAMLESS STEEL PIPE ROLLING OPERATION FOR MANUFACTURING SEAMLESS STEEL PIPE

TECHNICAL FIELD

This invention relates to a plug and a mandrel bar for a seamless steel pipe rolling operation and a method for manufacturing a seamless steel pipe, and more particularly a method for manufacturing a plug having as its outer shape a bullet-like shape, a rod-like member used for punching a hole at a steel piece, expanding a diameter of a pipe or extending a raw pipe which are installed as a tool of a pipe rolling machine such as a piercing machine, an elongating machine, a plug mill, a reel machine and a mandrel mill or the like and for manufacturing a seamless steel pipe using these materials.

In the specification of the present invention, the plug used in each of the aforesaid pipe rolling machines is properly called as a piercing plug, an elongating plug or the like by applying a name of the pipe rolling machine. In addition, in the case of the mandrel mill, the aforesaid rod-like member corresponds to a plug for another rolling machine and this is called as a mandrel bar.

BACKGROUND OF THE INVENTION

In order to manufacture a seamless steel pipe by applying a Mannesman Pipe Manufacturing Method, for example, at first a round steel piece heated up to a predetermined temperature (hereinafter called as a billet) is punched with the aforesaid plug by applying a slant type drilling machine called as a piercing machine and rolled to make a hollow raw pipe (hereinafter called as a hollow member). Then, the hollow member is rolled under application of a plug or a mandrel bar (hereinafter merely called as a bar) by the extending and rolling machine such as an elongating machine, a plug mill, a reel machine or a mandrel mill or the like in the same manner as that described above so as to reduce its wall thickness. Further, as required, after the rolled pipe is heated again, its outer diameter is reduced without using any plug in a squeezing rolling machine or a non-proportional rolling machine such as a reducing machine and a sizing machine. In this case, the hollow raw pipe rolled by a plug mill, a reel machine and a mandrel mill or the like is called as a shell.

However, the plug is always exposed under a high temperature and a high load through a continuous contact with the heated billet or hollow member at the stage of punching and rolling operation performed by the aforesaid piercing machine, resulting in that the plug is quite easily worn out and melt lost. In the prior art, since the plug was made of steel, the plug was heat treated at about 900 to 1000° C. as a countermeasure against a worn-out loss and a scale film of several 10 to several 100 $\mu$m was formed. However, when such a plug as above is used in making a pipe of high alloy steel containing Cr of 5 wt. % of which demand is increased in particular in recent years, the plug is merely endurable against several number of billets and its life is remarkably short.

Then, several number of technologies improving the life of the plug have been proposed by changing material quality of the plug. For example, either an official gazette of Japanese Patent Laid-Open No. Sho 60-159156 or an official gazette of Japanese Patent Laid-Open No. Sho 60-208458 proposes the plug raw material having Mo or W added to 3 wt. % Cr—1 wt. % Ni steel. However, there was a certain limitation in improvement of a life of the plug of piercing machine only through a utilization of such a material quality of steel system. For example, even if a billet with a diameter of 110 mm and a length of 2.5 m of SUS304 of austenite stainless steel is punched and rolled with a plug of the aforesaid raw material, a life of the plug is merely 3 pieces/unit (the number of billets which can be punched and rolled with one plug is three).

In addition, either an official gazette of Japanese Patent Laid-Open No. Sho 63-203205 or an official gazette of Japanese Patent Publication No. Hei 5-85242 has a proposal that a Mo group alloy is connected to the extremity end of the plug to increase a heat-resistant characteristic and an anti-wear characteristic. In addition, the official gazette of Japanese Patent Laid-Open No. Sho 62-244505 has a proposal of the same gist saying that a super-hard material is connected to the extremity end of the plug and ceramics is molten injected against the surface of the plug. In addition, the official gazette of Japanese Patent Laid-Open No. Sho 62-238011 has a proposal that a core material of the plug is made of ceramics and a metallic powder layer is hot pressed in isotropic pressure (normally called as an HIP processing). However, the plug having such a structure as above shows a disadvantage that a coupling of the raw materials is not kept during rolling operation and its life becomes shorter than that of the prior art.

In addition, the official gazette of Japanese Patent Laid-Open No. Hei 2-156037 has a proposal that there is provided a plug having a superior heat-resistant characteristic composed of a sintered member having a hard phase (a borite thermet) and a coupling phase having mainly Ni, Mo. When a billet composed of 13 wt. % Cr steel, for example, was punched under application of this plug, twelve billets could be punched with one plug. However, this degree of improvement is not sufficient for the operation.

In addition, the official gazette of Japanese Patent Laid-Open No. Sho 60-137511 has a proposal about a plug for manufacturing a seamless steel pipe in which the extremity end of ceramics is fixed to the steel substrate of the plug. Usually, the plug shows a different action against a pressed member in response to the specified location such as the extremity end, the work section and the reeling section or the like to be illustrated later. For example, the punching and rolling operation at the piercing machine is carried out such that the billet is punched at the extremity end, the produced raw pipe is rapidly decreased in its wall thickness at the work section and then the wall thickness of the raw pipe is adjusted at the reeling section. However, as described in the official gazette of Japanese Patent Laid-Open No. Sho 60-137511, even if only the extremity end is made of ceramics, it is frequently found that the work section or the reeling section is damaged, and in particular, the work section is remarkably damaged. That is, even if such a plug as above is employed for a punching and rolling operation, its life is not so extended as expected and a shape of the inner surface of the hollow member attained by the damage of the work section is not improved.

In turn, as a countermeasure for extending the life of the plug, there is provided a usage of plug in addition to a modification of the aforesaid material quality of the plug. Either the official gazette of Japanese Patent Laid-Open No. Sho 51-133167 or the official gazette of Japanese Patent Laid-Open No. Hei 1-180712, for example, has a proposal about a technology that the punching and rolling can be carried out while lubricant is being injected from the extremity end of the plug and in turn the official gazette of Japanese Patent Laid-Open No. Hei 5-138213 has a proposal about a technology that the punching and rolling can be performed after lubricant is coated in advance at the surface of the plug, respectively. However, the technology for injecting the lubricant from the extremity end of the plug shows a problem that the injection hole at the extremity end is clogged and in turn the technology for coating lubricant before punching and rolling operation shows a problem that only a required amount of lubricant can be uniformly coated at the surface of the plug. In addition, these both technologies have a common economical problem of increasing cost in manufacturing a pipe under the application of lubricant and so they may not employed in view of their industrial application.

The prior art described above related to the plug of the piercing machine in which the billet was punched and rolled. To the contrary, as for the plugs used in the slant type rolling machines such as an elongating machine and a reeling machine, various kinds of improvement technologies concerning the raw material and the method of use of the plug have been proposed in the same manner as that of the plug in the piercing machine. However, these proposed technologies (their description will be eliminated) do not accomplish the life of such a plug as one in which a pipe manufacturing company may not satisfy. In addition, as for the plug of the plug milling machine and the mandrel bar or the like to be used in the rolling of the inner surface of the hollow member, a life of the plug or the bar in a punching type rolling machine (such as a plug mill, a mandrel mill or the like) which may be sufficiently adapted can not be attained in the same manner as that described above.

DISCLOSURE OF THE INVENTION

In view of the circumstances described above, the present inventors have vigorously studied about an extension of life of the plugs and bars for use in manufacturing a seamless steel pipe. The study was carried out such that as the rolled material, the billet of high alloy steel was selected in the model mill of which size was reduced to about ⅓ of that of the actual machine, various kinds of experiments of punching and rolling as well as extending and rolling were performed and then the attained results were confirmed afterwards by the actual machine.

As a result, the countermeasure based on the method of using the plug together with lubricant shows a problem of which resolution is quite difficult such as a clogging at the injection hole caused by lubricant or its increased cost. To the contrary, it has been concluded that the improvement caused by modification of material quality of the plug needs a certain amount of improvement under utilization of a recent development or an improved raw material.

In other words, it is an object of the present invention to provide a new plug and a new bar for use in rolling a seamless steel pipe capable of more remarkably improving a life than that of the prior art even under a severe condition of application always exposed to a high temperature and a high load. Then, the present invention provides a method for attaining a seamless steel pipe having a more superior quality than that of the prior art under application of these members.

The present invention accomplishing these objects is constructed as follows.

The first one of the present invention relates to a plug for rolling a seamless steel pipe which is used for punching a hole in a steel piece or adjusting an inner diameter or an outer diameter of a punched raw pipe, of which outer appearance shape is of a bullet-shape and comprised of an extremity end part, a work part, a reeling part and a parallel part characterized in that at least a surface layer of the aforesaid extremity end and a surface layer of the work part is made of ceramics.

The second one of the present invention relates to a plug for rolling a seamless steel pipe in which the first one of the present invention is added with the fact that at least the surface layer of the aforesaid reeling part is made of ceramics.

The third one of the present invention relates to a plug for rolling a seamless steel pipe which is used for punching a hole in a steel piece or adjusting an inner diameter or an outer diameter of a punched raw pipe, of which outer appearance shape is of a bullet-shape characterized in that an entire assembly of the aforesaid plug is made of ceramics.

The fourth one of the present invention relates to a mandrel bar for use in rolling a seamless steel pipe in which it is used for adjusting an inner diameter or an outer diameter of a raw pipe, its shape is of a rod-like member and it is comprised of an extremity end part and a work part characterized in that at least the surface layer of the aforesaid extremity end part and the surface layer of the work part is made of ceramics.

The fifth one of the present invention relates to a mandrel bar for use in rolling a seamless steel pipe in which it is used for adjusting an inner diameter or an outer diameter of a raw pipe and its shape is of a rod-like member characterized in that an entire assembly of the aforesaid mandrel bar is made of ceramics.

The sixth one of the present invention relates to a mandrel bar for use in rolling a seamless steel pipe in which it is installed in a piercing machine and the aforesaid ceramics used in the first to the third ones of the present invention has a bending strength of more than 200 MPa at a temperature of 1200° C.

The seventh one of the present invention relates to a mandrel bar for use in rolling a seamless steel pipe in which the aforesaid ceramics related to the sixth one of the present invention further has a bending strength of more than 200 MPa at a temperature of 1200° C.

The eighth one of the present invention relates to a mandrel bar for use in rolling a seamless steel pipe in which the aforesaid ceramics related to the seventh one of the present invention further has a bending strength of more than 200 MPa at a temperature of 1300° C.

The ninth one of the present invention relates to a mandrel bar for use in rolling a seamless steel pipe in which it is installed at an elongating machine or a plug mill and the aforesaid ceramics related to the first to third ones of the present invention further has a bending strength of more than 200 MPa at a temperature of 800° C.

The tenth one of the present invention relates to a mandrel bar for use in rolling a seamless steel pipe in which it is installed at an elongating machine or a plug mill and the aforesaid ceramics related to the ninth one of the present invention further has a bending strength of more than 200 MPa at a temperature of 1000 to 1200° C.

The eleventh one of the present invention relates to a mandrel bar for use in rolling a seamless steel pipe in which it is installed at a reel machine and the aforesaid ceramics related to the first to the third ones of the present invention further has a bending strength of more than 200 MPa at a temperature of 800° C.

The twelfth one of the present invention relates to a mandrel bar for use in rolling a seamless steel pipe in which it is installed at a reel machine and the aforesaid ceramics related to the eleventh one of the present invention further has a bending strength of more than 200 MPa at a temperature of 800 to 1200° C.

The thirteenth one of the present invention relates to a method for manufacturing a seamless steel pipe characterized in that a piercing machine is provided with a plug related to any one of the first to third ones and the sixth to eighth ones of the present invention and a steel piece is punched and rolled with the aforesaid plug.

The fourteenth one of the present invention relates to a method for manufacturing a seamless steel pipe characterized in that a piercing machine is provided with a plug related to any one of the first to third ones and the sixth to eighth ones of the present invention and a steel piece is punched and rolled with the aforesaid plug.

The fifteenth one of the present invention relates to a method for manufacturing a seamless steel pipe characterized in that a reel machine is provided with a plug related to any one of the first to third and eleventh to twelfth ones of the present invention and the aforesaid raw pipe is rolled by the aforesaid plug.

The sixteenth one of the present invention relates to a method for manufacturing a seamless steel pipe characterized in that a plug mill is provided with a plug related to any one of the first to third ones of the present invention and the aforesaid raw pipe is rolled by the aforesaid plug.

The seventeenth one of the present invention relates to a method for manufacturing a seamless steel pipe characterized in that a mandrel mill is provided with a mandrel bar related to any one of the fourth or fifth one of the present invention and the aforesaid raw pipe is rolled by the aforesaid mandrel bar.

Accordingly, the present invention is constructed such that as raw material for the plug and the bar for a seamless steel pipe, ceramics is employed, resulting in that a life of these members is substantially improved. In addition, as a result of the arrangement in which either the aforesaid plug or the aforesaid bar is applied for manufacturing the seamless steel pipe, time required for performing a replacing work for these members is shortened and its productivity is remarkably improved more than that of the prior art.

PREFERRED EMBODIMENTS OF THE INVENTION

At first, before describing the preferred embodiments of the present invention, a shape of each of the plug and the bar applied for the aforesaid experiments as well as their methods of experiment will be described.

Figure 1:
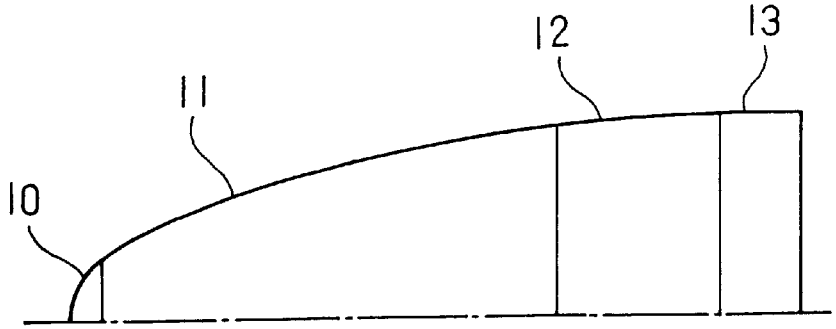
FIG. 1 is a view for showing an outer appearance shape of a plug of a piercing machine.
Figure 2:
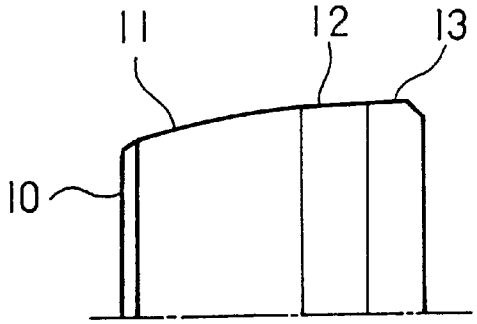
FIG. 2 is a view for showing an outer appearance shape of a plug of an elongating machine.
Figure 3:
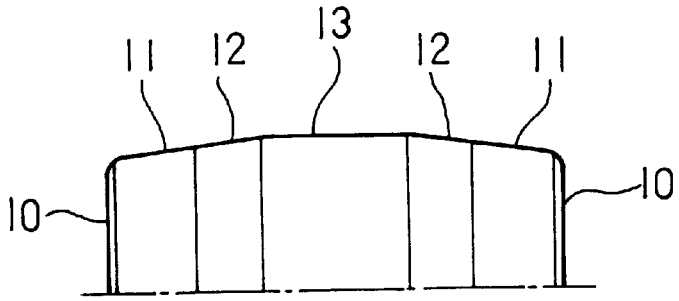
FIG. 3 is a view for showing an outer appearance shape of a plug of a plug mill machine.
Figure 4:
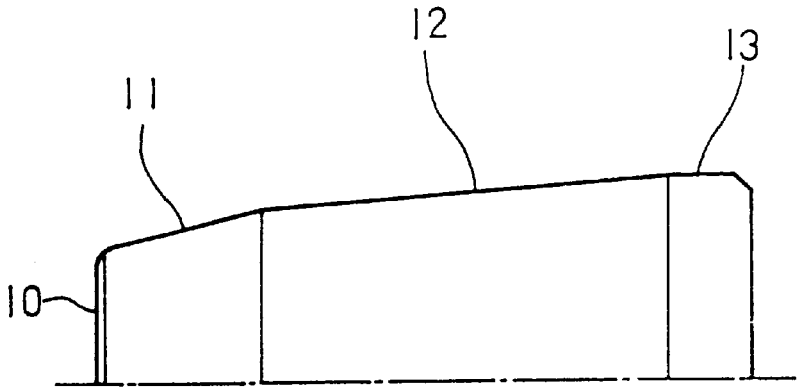
FIG. 4 is a view for showing an outer appearance shape of a plug of a reel machine.
Figure 5:
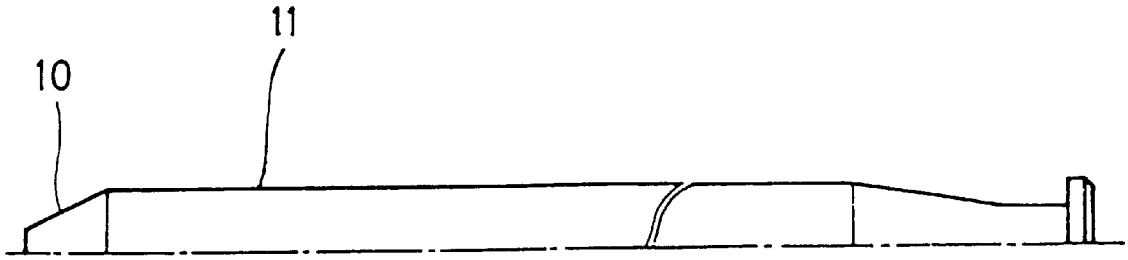
FIG. 5 is a view for showing an outer appearance shape of a mandrel bar.

As shown in FIG. 1, a plug 1 of a piercing machine is constructed such that each of segments of the plug is defined as an extremity end section 10 (a length: 3 mm, R 10 mm), a work section 11 (a length: 40 mm), a reeling section 12 (a length: 50 mm, a slant angle 3.25°) and a parallel section 13 (a length: 15 mm, ϕ42 mm) and each of these sections is discriminated by its action. That is, the extremity end section 10 is a part where a hole is punched at the central part of the billet, the work section 11 is a part where a pipe wall thickness is reduced with a clearance being left against the roll, the reeling section 12 is a part where a pipe wall thickness is finished with a clearance being against the roll, and the parallel section 13 is a part where a removal of the hollow member from the plug is made smooth. In addition, these positions are made different in reference to a shape of the plug. The states would become apparent in reference to a plug 2 of an elongating machine in FIG. 2 of which outer shape appearance is different from that of the plug 1 of the piercing machine (a length of the extremity section 5 mm, R 10 mm, a length of the work section 30 mm, a length of the reeling section 45 mm, a slant angle 3.75°, a length of parallel section 15 mm, ϕ48 mm), the plug 3 of a plug mill in FIG. 3 (a forward or rearward symmetrical shape, the extremity end section 2 mm, R 5 mm, a length of the work section 5 mm, a length of the reeling section 10 mm, a slant angle 10°, a length of parallel section 20 mm, ϕ49 mm), and a plug 4 of a reeling machine in FIG. 4 (an extremity end section 3 mm, R 10 mm, a length of the work section 20 mm, a length of the reeling section 60 mm, a slant angle 11.5°, a length of parallel section 15 mm, ϕ53 mm). The number with ϕ in a parenthesis indicates an outer diameter of the maximum section. As described above, the mandrel bar 5 in FIG. 5 forms a rod-like member in which the plug and the plug bar supporting the plug are integrally assembled (a length of the extremity end section 3 mm, R 26.5 mm, a length of the work section 3000 mm, ϕ53 mm). As shown in FIG. 5, a pipe wall thickness at a part of the mandrel bar of which outer appearance shape is approximately parallel is reduced, so that the parallel part of its outer appearance of the mandrel bar of the present invention is called as a work section.

In the experiment of the plug corresponding to the present invention, four kinds of ceramics powder of SiC, $ZnO_2$, $Al_2O_3$, $Si_3N_4$ were used as the aforesaid ceramics. Then, the plug was manufactured in such a way that each of these ceramics powder was molded individually, baked, and then finished into the shapes shown in FIGS. 1 and 2 to 5 by a grinding operation. During this operation, the molding was performed such that the ceramics powder was mixed with sintered member such as glass, finished into the shape of plug (rough shape in view of shrinkage caused by baking), the baking was carried out in baking and solidifying within a furnace (an atmospheric furnace or an atmospheric control or isohydraulic furnace or the like) and the grinding was performed with a diamond grinding stone to make a grinding finish. In addition, the plug of the present invention may be kept at a state in which it is not ground finished, but it is left in its baked condition in view of rolling condition.

Then, an experiment of rolling of these plug and bar was carried out under application of the plugs or bars shown in FIGS. 1 to 5 above and material quality of the entire plug or bar was changed as follows.

At first, the billet of SUS304 with ϕ50 mm heated up to 1250° C. was rolled by a model piercing machine into a hollow member with an outer diameter of ϕ55 mm. After this operation, this hollow member was cooled with air and passed in sequence through the following two steps of ① and ② to make a shell member. Then, a life of the plug and the bar used in each of the model mills was evaluated.

① After it was heated again up to 1050° C., the material was rolled by the mandrel mill having 5 stands into a shell of ϕ50 mm.

② After it was heated again up to 1150° C., it was rolled by the elongating machine into the hollow member having ϕ60 mm, cooled with air, heated again up to 1050° C., thereafter it was rolled by the plug mill into the shell member having ϕ57.5 mm, cooled with air, heated again up to 1000° C., thereafter it was rolled by a reeling machine into a shell having ϕ60 mm.

In this case, the prior art of which life was compared with that of the plug and the bar of the present invention is the same as that of each of the plugs shown in FIGS. 1 to 5 and its material quality is as follows.

The plug of the piercing machine and the plug of the elongating machine are made of casted steel of 0.3 wt. % C—0.3 wt. % Cr—1 wt. % Ni and oxidation scale is generated at the surface by a heat treatment. The mandrel bar corresponds to the JIS standards (SKT6), this is also processed by a heat treatment to form an oxidation scale at the surface, thereafter lubricant of graphite system is coated on it. The plug of the plug mill is made of casted steel with 1.5 wt. % C—18 wt. % Cr—1.5 wt. % Ni, an oxidation scale is produced at the surface by a heat treatment and lubricant of graphite system is coated on it. The plug of reeling machine is made of casted iron of 3 wt. % C—0.6 wt. % Cr—0.4 wt. % Ni system and this is left without being heat treated while it is machined.

Results of experiment under application of the plug and bar of the present invention and the prior art members will be described.

Table 1 indicates a life of each of the plug and the bar. In this case, the life is evaluated in reference to the number (called as a durable number) of rolled members (billet, hollow member or shell) which are rolled until one plug or bar is worn out under its continuous application in use and the worn-out member is replaced with another member.

TABLE 1

| | Durable number of plug of piercing machine | Durable number of mandrel bar | Durable number of plug of elongating machine | Durable number of plug of plug mill | Durable number of plug of reel machine |
|---|---|---|---|---|---|
| Prior Art | 2 | 55 | 4 | 5 | 13 |
| Present Invention | | | | | |
| SiC | 123 | 3,115 | 256 | 506 | 1,142 |
| $Al_2O_3$ | 141 | 3,882 | 275 | 486 | 1,568 |
| $ZrO_2$ | 181 | 4,416 | 326 | 651 | 1,922 |
| $Si_3N_4$ | 156 | 4,006 | 301 | 466 | 1,631 |

In reference to Table 1, it is apparent that the plugs and the bars of the present invention of which entire products are made of ceramics whatever type of rolling machines may be applied show a longer life than that of the prior art product. During this process, the pipe rolled by the plug and the bar of the present invention showed no baking stain (evaluating method: visual discrimination at the surface of the tool after applying a rolling operation and water-cooling). Such a baking stain was generated in the rolling operation for the prior art product, for every 1 to 3 pipes in the piercing machine, every 3 to 6 pipes in the elongating machine and the plug mill, every 10 to 15 pipes in the reel machine and every 50 to 70 pipes in the mandrel mill.

In view of the foregoing and in response to these results, the present invention, as the present third and fifth inventions, required at first that the entire plug and bar are made of ceramics. Accordingly, it can be expected that, if the actual plug and bar for use in rolling the seamless steel pipe are manufactured in such a way as described above, the life of these members can be reached up to such a level as one which could be attained.

In addition, a similar effect can be expected even if the entire plug or bar is not made of ceramics, but partially made of ceramics. In the case that the plug having the outer appearance shape shown in FIG. 1 is used as the plug of the elongating machine and the plug of the reel machine, for example, it can be expected that, if each of the members corresponding to the outer appearance shape shown in FIGS. 2 and 3 (the extremity end section 10 and the work section 11 or the reeling section 12 is also added) is replaced with ceramics, the plug has an approximate same life as that of the plug of which entire material is made of ceramics. In addition, since the effect attained by ceramics is assumed to be caused by the fact that deformation at the surface of the plug and melt loss under a high temperature are scarcely found as compared with that of the scaled steel, it may also be applicable that only the surface layer except the inner part of the plug, i.e. the portion processed with ceramics is made of ceramics. In other words, the inner part of the plug is made of raw material of steel in the same manner as that of the prior art.

Figure 6B:
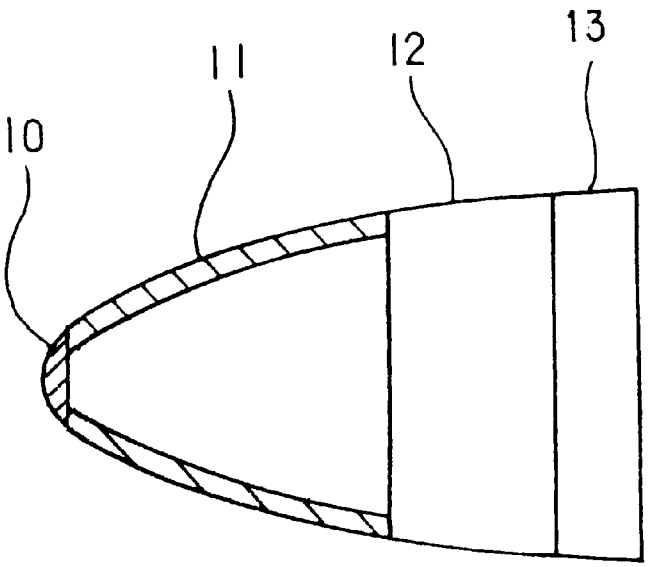
FIGS. 6(*a*)–6(*b*) are views for showing an outer appearance shape of a plug of the present first invention.
Figure 6A:
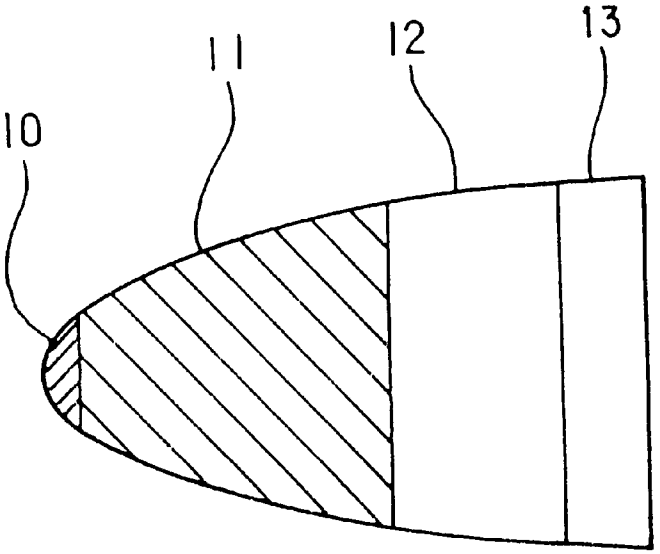
Figure 7B:
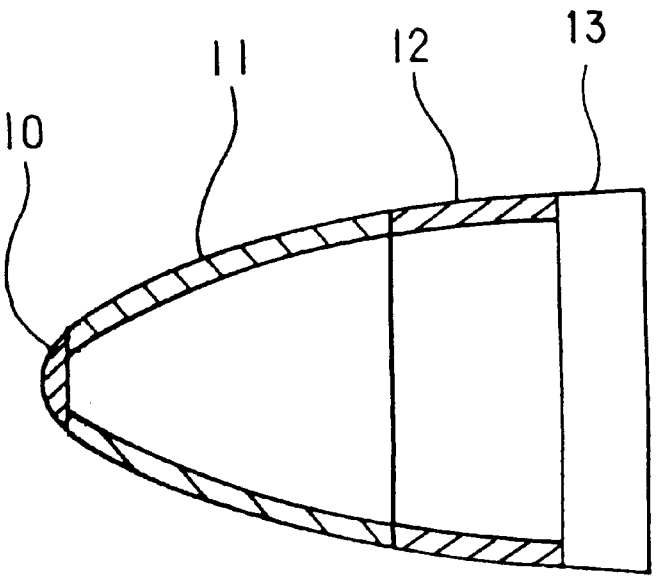
FIGS. 7(*a*)–7(*b*) are views for showing an outer appearance shape of a plug of the present second invention.
Figure 7A:
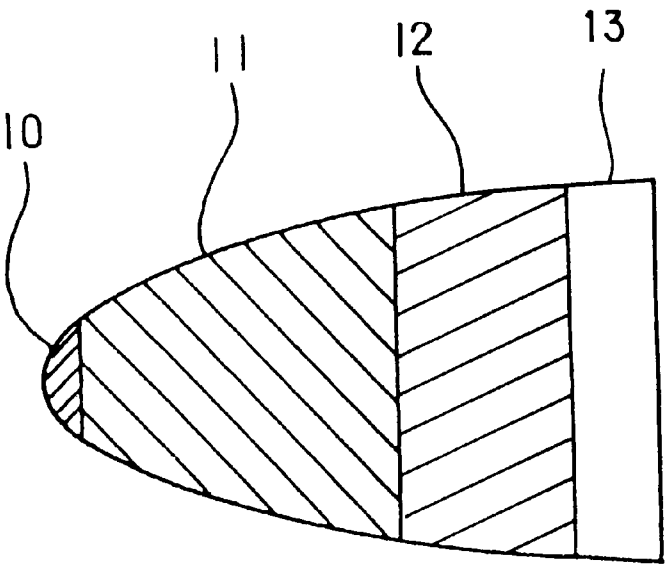

In view of the foregoing, in order to confirm this expectation, the present inventors applied to a rolling experiment a plug of a piercing machine in which the extremity end section 10 and the work section 11 shown in FIG. 6(*a*) indicating a plug section are made of ceramics (hatched line), the surface layer section of 6 mm at each of the extremity end section 10 and the work section 11 shown in FIG. 6(*b*) is made of ceramics (hatched line) and the remaining sections are made of material quality of the prior art product. In addition, as the plug section, the present inventors applied to a rolling experiment a plug of a piercing machine in which the extremity end section 10 to the reel section 12 shown in FIG. 7(*a*) is made of ceramics (hatched line) and only the surface layer of 5 mm at each of the extremity end section 10 to the reel section 12 shown in FIG. 7(*b*) is made of ceramics (hatched line) and their inner sections as well as other remaining sections are made of material quality of the prior art product. They correspond to the present first and second inventions. Further, the size of the entire plug and the conditions of experiment are the same as those of the aforesaid experiment.

In addition, in the case that either the plug or the bar having such a complex structure as above, silica alumina heat-resistant adhesive agent (silica: silicon oxide, alumina: aluminum oxide) was used for connecting the ceramics (hatched line) with the prior art steel member (other than the hatched line) If such a coupling as above is carried out, the different raw materials are hardly peeled off from each other during its use even though the plug or the bar having the complex structure is applied. Further, the present invention is not only limited to this coupling method, but also other coupling methods such as a sintering fit and a screw coupling or the like may be applied.

The results of the experiment is indicated in Table 2 in reference to the number of durable pipes under a continuous application of the plug. In reference to Table 2, it is apparent that the plug of which partial portion is manufactured by ceramics can attain a remarkable improvement in life. Accordingly, if the coupling strength between the ceramics and other materials can be maintained more than an allowable value corresponding to the condition of application of the plug, the location where a severe wearing loss is naturally expected is made of ceramics as required and other portions can be replaced with other materials such as steel, carbon or the like. It is of course apparent that such other materials may be of a single material or complex material.

TABLE 2

| Plug of a piercing machine (ceramics) | Durable Number | | | | | |
|---|---|---|---|---|---|---|
| | | | Present invention 1 (– work section) | | Present invention 2 (– reel section) | |
| | Prior 1 (Not used) | Prior 2 (Extremity end) | Entire | Only the surface layer | Entire | Only the surface layer |
| Casted steel (Prior art) | 2 | — | — | — | — | — |
| SiC | — | 91 | 421 | 315 | 470 | 371 |
| $Al_2O_3$ | — | 100 | 505 | 402 | 538 | 420 |
| $ZrO_2$ | — | 138 | 658 | 451 | 701 | 489 |
| $Si_3N_4$ | — | 125 | 575 | 435 | 626 | 463 |

Since the present first to second and fourth inventions are made on the basis of this technical concept, if they are applied to the manufacturing of the seamless steel pipe in place of the aforesaid present third and fifth inventions as required, they may provide the similar effects to that of the present third and fifth inventions. That is, in order to attain the plug and the bar having a sufficient longer life than that of the prior art, it is necessary that at least a part ranging from the extremity end of the plug to the work section is formed by ceramics. In addition, although same effect can be attained even if only the surface layer ranging from the extremity end of the plug to the work section is made of ceramics, in this case, the thickness of the surface layer section is more than 3 mm at the extremity end to the work section and the reel section shows more than 3 mm at its interface with the work section and more than 1 mm at its interface with the parallel section. If not, it is not preferable due to the fact that it may not be durable against a tensile force generated inside (at an interface side with the steel material) the ceramic section under an application of an external load and it may be damaged.

In addition, the present inventors performed the high temperature bending test (JIS R 1601 Three-Point Bending Test) for the ceramics in concurrent with the aforesaid rolling experiment, arranged the results and attained a relation between the ceramic bending strength and the life of the plug. In this case, each of the bending strengths of the ceramics is changed by attaining various states of forming and baking conditions. As the forming conditions, they are a combination of ceramics crystalline particle shape (from flake to particle, or spherical shape), a grain size and a mixed glass type binder (alumina system, boric acid and others, or their complex state) and as the baking conditions, there are provided a holding temperature (700° to 1600° C.), a cooling speed, atmosphere and pressurizing force or the like.

FIGS. 8, 9, 10 and 11 illustrate a relation between a life of each of the plug of a piercing machine, the plug of an elongating machine, the plug of a plug mill and the plug of a reel machine (against the prior art) and a ceramics bending strength in this sequence, respectively. In these figures, the bending strength at 1000° C., for example, is expressed as "a strength at 1000° C.".

The present sixth to twelfth inventions have been accomplished on the basis of the result of a high temperature bending test for such ceramics, wherein the ceramics of the plugs in each of the present first to third inventions are restricted under the preferable high temperature bending strength in response to an applied rolling machine, such as a piercing machine, an elongating machine and a reel machine, for example. Each of the reasons of restriction will be described as follows.

Present Sixth to Eighth Inventions (The Plug of Piercing Machine)

Figure 8:
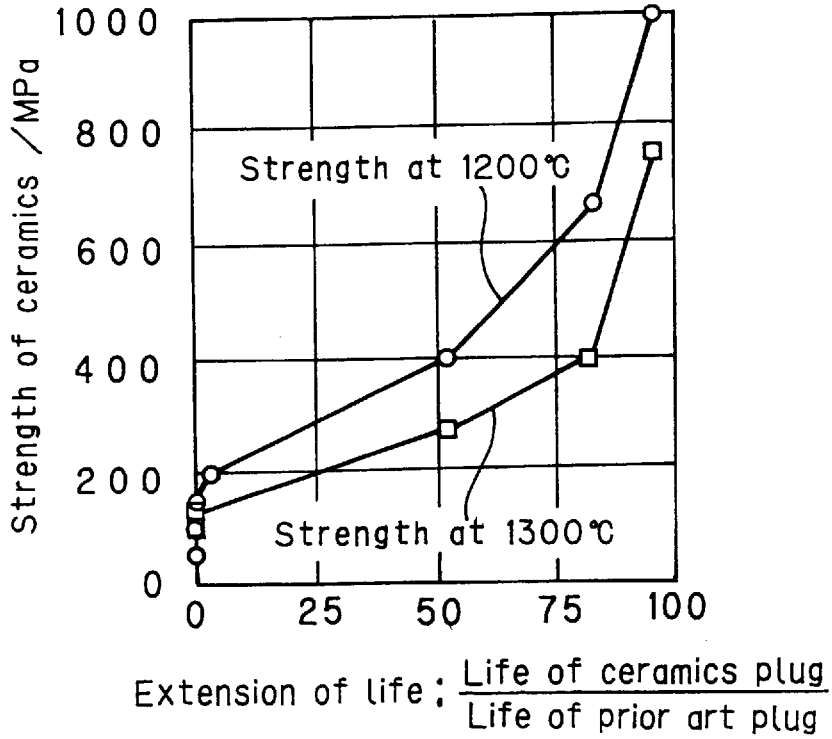
FIG. 8 is a view for showing a relation between a plug life of a plug of a piercing machine (as compared with that of the prior art) and a bending strength of ceramics.

As shown in FIG. 8, the life of the plug of the piercing machine is improved as a bending strength of the applied ceramics is increased. Then, the extension of life is increased at a value more than 200 MPa of a strength at 1200° C. and further the life of more than fifty times of that of the prior art product under a condition of more than 400 MPa of a strength at 1200° C. or more than 200 MPa of a strength at 1300° C. can be attained. In this case, the applied ceramics is $Si_3N_4$, for example.

Thus, the present sixth invention is the plug of the piercing machine in which a high temperature bending strength of ceramics has a preferable range more than 200 MPa at 1200° C., the present seventh invention is the plug of the piercing machine having a strength of more than 400 MPa at 1200° C., and the present eighth invention is the plug of the piercing machine having a strength of more than 200 MPa at 1300° C.

Present Ninth to Tenth Inventions (The Plug of the Elongating Machine)

Figure 9:
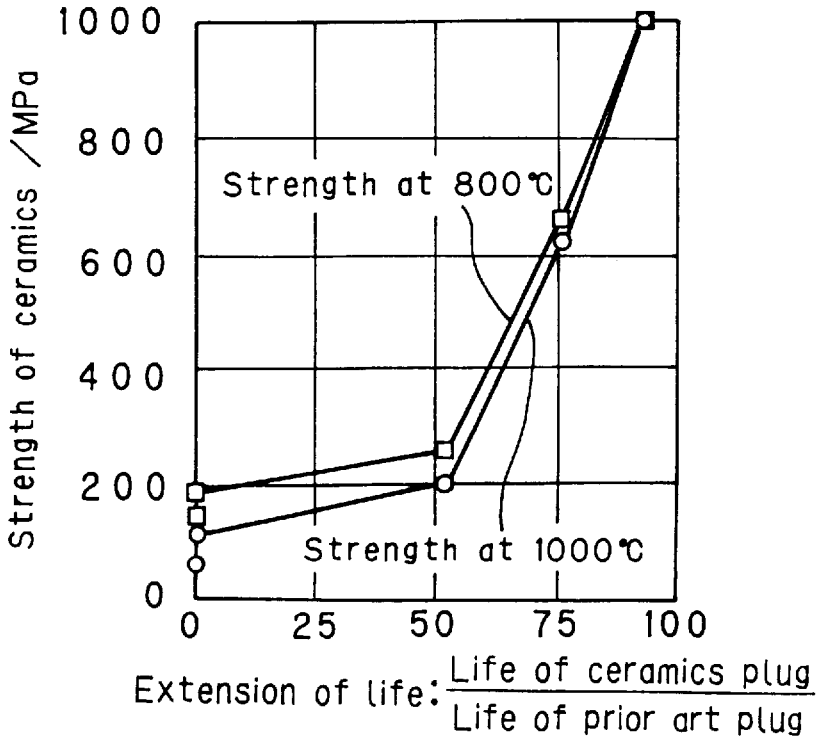
FIG. 9 is a view for showing a relation between a plug life of a plug of an elongating machine (as compared with that of the prior art) and a bending strength of ceramics.

As shown in FIG. 9, the life of the plug of the elongating machine is improved as a bending strength of the applied ceramics is increased. Then, the extension of life of it can be increased at a strength of more than 200 MPa at 800° C., and further the life of more than fifty times of that of the prior art product can be attained at a strength of more than 200 MPa at 1000° C. In general, the rolling temperature during rolling of the elongating machine does not exceed 1200° C. Further, in this case, the applied ceramics is $ZnO_2$, for example.

Present Ninth to Tenth Inventions (The Plug of the Plug Mill)

Figure 10:
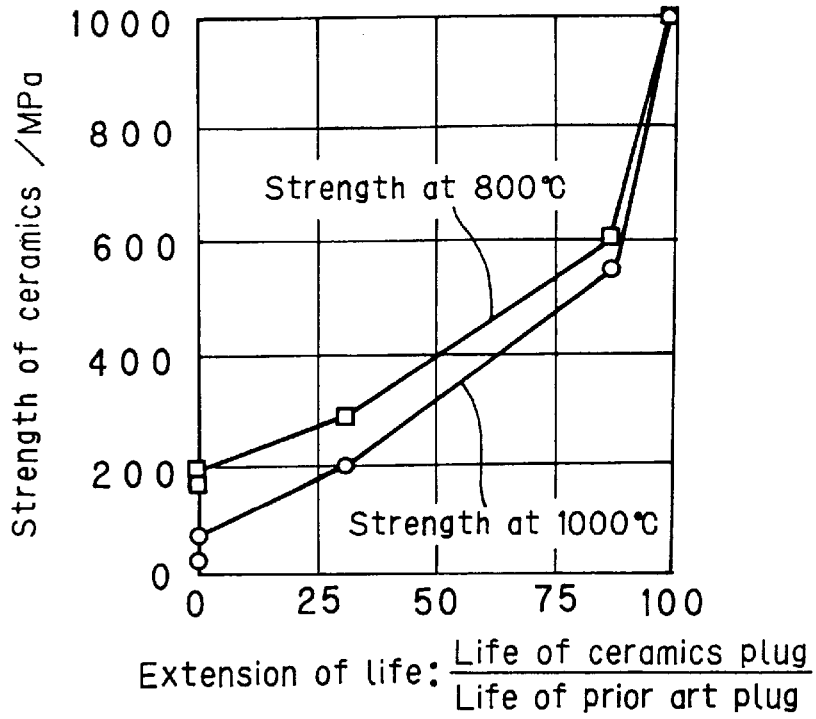
FIG. 10 is a view for showing a relation between a plug life of a plug of a plug mill machine (as compared with that of the prior art) and a bending strength of ceramics.

As shown in FIG. 10, the life of the plug mill is improved as the bending strength of the applied ceramics is increased. Then, the extension of life at a strength of more than 200 MPa at 800° C. is increased and a life more than thirty times of that of the prior art product can be attained at a strength of more than 200 MPa at 1000° C. In general, there occurs no possibility that the rolling temperature at the time of rolling operation of the plug mill exceeds 1200° C. In addition, in this case, the applied ceramics is SiC, for example.

Thus, as a preferable range of the high temperature bending strength of the ceramics of the plug of the elongating machine or the plug of the plug mill, the present ninth invention defined it more than 200 MPa at 800° C. and as a further preferable range, the present tenth invention defined it more than 200 MPa at 1000 to 1200° C.

Present Eleventh to Twelfth Inventions (The Plug of Reel Machine)

Figure 11:
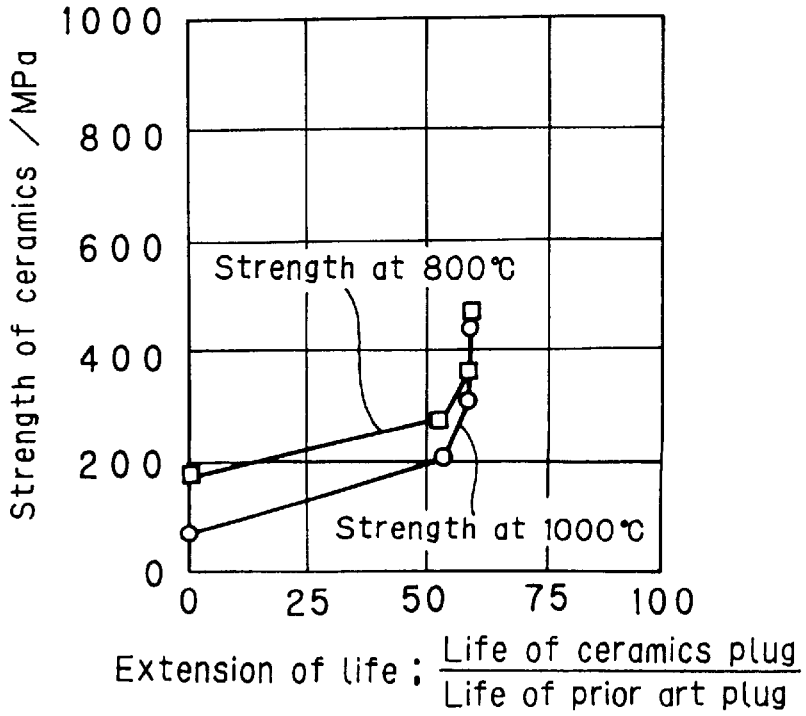
FIG. 11 is a view for showing a relation between a plug life of a plug of a reel machine (as compared with that of the prior art) and a bending strength of ceramics.

As shown in FIG. 11, the life of the reel machine is improved as the bending strength of the applied ceramics is increased. Then, the extension of life at a strength of more than 200 MPa at 800° C. is increased and a life more than hundred times of that of the prior art product can be attained at a strength of more than 200 MPa at 1000° C. In general, there occurs no possibility that the rolling temperature at the time of rolling operation of the reel machine exceeds 1000° C. In addition, in this case, the applied ceramics is $Al_2O_3$, for example.

Thus, as a preferable range of the high temperature bending strength of the ceramics of the plug of the reel machine, the present eleventh invention defined it more than 200 MPa at 800° C. and as a further range which is more suitable for actual case, the present twelfth invention defined it more than 200 MPa at 800 to 1200° C.

Lastly, the method for manufacturing a seamless steel pipe of the present invention will be described as follows.

The present thirteenth invention relates to a method in which the plug of any of the present first to third, and sixth to eighth inventions is applied to the piercing machine so as to make a hole at the billet and then the billet is rolled, the processings at the subsequent to the hollow member may be carried out in any method of rolling operation. That is, it may also be applicable that all the plugs or bars in the present invention are used in the rolling machine subsequent to the elongating machine and the well-known prior art product may be used.

In addition, the present fourteenth invention is operated such that the plugs of the present first to third and ninth to tenth inventions are applied to the elongating machine so as to roll the hollow member, wherein the punching stage at the piercing machine in the prior stage or the processing in subsequent stages is not restricted in particular.

In addition, the present fifteenth invention is operated such that the plugs of any ones of the present first to third and eleventh to twelfth inventions are applied to the reel machine so as to roll the hollow member, wherein the present sixteenth invention is additionally operated such that the plugs of any one of the present first to third and ninth to tenth inventions are installed at the plug mill so as to roll the hollow member and the present seventeenth invention is operated such that the bar of the present fourth or fifth invention is installed at the mandrel mill so as to roll the hollow member. In this case, all the inventions do not restrict either the plug or the bar in particular to the product of the present invention during the processing other than that of the target rolling machine.

According to the present thirteenth to seventeenth inventions, the seamless steel pipe is manufactured under application of either the plug or the bar of the present invention having a remarkable longer life than that of the prior art product, so that there may be generated various useful effects in industry such as a cost reduction caused by a decreased unit of tool, and an improved productivity caused by reduction of frequent replacement of the tool or the like.

EXAMPLES

Each of ceramic powders of four kinds of ceramics such as SiC, $ZnO_2$, $Al_2O_3$, and $Si_3N_4$ was press formed individually and baked to adjust a strength at 1000° C. to the aforesaid values of 1000 Mpa, 1000 MPa, 450 MPa, and 1000 MPa, respectively. Then, each of the raw materials was finished into a product in which the material shows an outer appearance shape of each of the entire ceramic plugs shown in FIGS. 1 to 5 with an enlarged size of expanded rate, another product partially made of ceramics, a plug and a bar in which a part of the surface layer except the inner side is made of ceramics and then they were used in the following examples 1 and 2.

Example 1

Billet (ϕ175 mm) made of high alloy steel having a higher deformation resistance than that of 9 wt. % Cr steel was rolled in sequence by the plugs shown in FIGS. 1 to 5 in the piercing machine and the mandrel mill with its expansion rate being three times so as to manufacture the seamless steel pipe.

At that time, the mandrel bars were used at both piercing machine and mandrel mill in which a surface layer depth of 35 mm down to the plug of the piercing machine and the work section (the outer appearance parallel section) entirely made of ceramics up to the parallel section of the present invention was made of ceramics.

The results are indicated in Table 3 as compared with that of the using the prior art product. In addition, evaluation of the plugs and the bars of the present invention was carried out in reference to the desired number of them when 40000 pieces of the aforesaid billets were rolled.

TABLE 3

| | Desired Number/ 40000 billets | | |
|---|---|---|---|
| Material Quality of Tool | Plug of Piercing Machine | Mandrel Bar | Note (Strength of Ceramics) |
| Prior Art Product | 3,334 | 170 | — |
| Present Invention | | | |
| SiC | 16 | 3 | 600 MPa (800° C.) |
| $Al_2O_3$ | 12 | 3 | 500 MPa (800° C.) |

TABLE 3-continued

| Material Quality of Tool | Desired Number/ 40000 billets | | Note (Strength of Ceramics) |
|---|---|---|---|
| | Plug of Piercing Machine | Mandrel Bar | |
| $ZrO_2$ | 11 | 3 | 750 MPa (1000° C.) |
| $Si_3N_4$ | 13 | 3 | 500 MPa (1300° C.) |

In reference to Table 3, it becomes apparent that the desired number of the plugs and bars of the present invention is remarkably reduced to less than 1/100 for the plug of the piercing machine and less than 1/50 for the mandrel bar and further their lives can be remarkably improved. It is quite natural to say that the frequent time of replacement of these members was remarkably reduced and a productivity of the seamless steel pipe was also improved. In addition, the rolling time at the piercing machine was reduced by 20% due to the reduction in plug resistance during the rolling operation. The amount of use of the lubricant for the mandrel bar was reduced by 30%.

Example 2

Billet (ϕ350 mm) made of high alloy steel having a higher deformation resistance than that of 16 wt. % Cr steel was rolled in sequence by the plugs shown in FIGS. 1 to 5 in the piercing machine, an elongating machine, a plug mill and a reel machine with its expansion rate being set to 6.5 so as to manufacture the seamless steel pipe. At that time, the plugs of the present invention were used at all the aforesaid rolling machines. In this case, the entire piercing machine used the plug in which the entire assembly up to the reel section was made of ceramics, the elongating machine used the plug in which the surface layer depth down to the work section of 80 mm was made of ceramics, the plug mill used the plug in which the entire surface layer depth of 70 mm was made of ceramics and the reel machine used the plug in which the surface layer depth of 25 mm down to the reel section was made of ceramics.

The results are indicated in Table 4 as compared with that of the using the prior art product in all the rolling machines. In addition, evaluation of the plugs of the present invention was carried out in reference to the desired number of them when 5000 pieces of the aforesaid billets were rolled.

TABLE 4

| Material Quality of Tool | Desired Number/5,000 Billets | | | | Note (Strength of Ceramics) |
|---|---|---|---|---|---|
| | Plug of Piercing Machine | Plug of Elongating Machine | Plug of Plug Mill | Plug of Reel Machine | |
| Prior Art Product | 1,250 | 556 | 715 | 239 | — |
| Product of the Present Invention | | | | | |
| SiC | 8 | 5 | 5 | 2 | 600 MPa (800 ° C.) |
| $Al_2O_3$ | 7 | 4 | 5 | 2 | 500 MPa (800 ° C.) |
| $ZrO_2$ | 6 | 3 | 4 | 2 | 750 MPa (1000 ° C.) |
| $Si_3N_4$ | 7 | 4 | 5 | 2 | 500 MPa (1300 ° C.) |

In reference to Table 4, it becomes apparent that the desired number of the plugs of the present invention is remarkably reduced to less than 1/100 for each of the plugs of the piercing machine, the elongating machine, the plug mill and the reel machine and further their lives can be remarkably improved. It is quite natural to say that the frequent time of replacement of these members was remarkably reduced and a productivity of the seamless steel pipe was also improved. In addition, since the surface of the plug was smooth, the surface roughness at the inner surface of the rolled pipe was improved from Rmax of 35 μm to 5 μm in a mean value. Further, an amount of occurrence of the scale engaging stain at the inner surface of the pipe was reduced by 75% and the number of steps of handling was also reduced by the same amount.

Applicability in Industry of the Invention

Application of the present invention in an industry shows that the wearing loss of either the plug or the mandrel bar installed in each of the rolling machines during the manufacturing of the seamless steel pipe is substantially reduced than that of using the prior art product. As a result, the stock of these members can be reduced and not only their manufacturing cost can be reduced, but also the frequent time of replacement can be reduced, so that the time required for performing the replacement work is shortened and the productivity of the seamless steel pipe is also improved. In addition, since the shape of the plug or the mandrel bar is made stable, it is possible to attain the seamless steel pipe having a superior inner surface quality as well as a superior size accuracy. This effect is remarkable in particular in case of manufacturing the steel pipe made of high alloy steel of which deformation resistance is high and rolling operation is hardly carried out.

What is claimed is:

1. A bullet-shaped plug for rolling a seamless steel pipe, the plug being used for punching a hole in a steel piece or adjusting an inner diameter or an outer diameter of a punched raw pipe, the plug comprising:

an extremity end part;

a work part;

a reeling part; and a parallel part, wherein at least a surface layer of the extremity end part and at least a surface layer of the work part are made of ceramic material, the surface layer of the extremity end part being at least 3 mm thick, wherein the extremity end part, the work part and the reeling part are integral, and wherein said ceramic material has a bending strength of 400 MPa or more at a temperature of 1200° C.

2. A plug for rolling a seamless steel pipe according to claim 1, wherein at least a surface layer of the reeling part is made of ceramic material.

3. A plug for rolling a seamless steel pipe according to claim 1, wherein an entire assembly of said plug is made of ceramic material.

4. A bullet-shaped plug for rolling a seamless steel pipe the plug being used for punching a hole in a steel piece or adjusting an inner diameter or an outer diameter of a punched raw pipe, the plug comprising:

an extremity end part;

a work part;

a reeling part; and a parallel part, wherein at least a surface layer of the extremity end part and at least a surface layer of the work part are made of ceramic material, the surface layer of the extremity end part being at least 3 mm thick, wherein the extremity end part, the work part and the reeling part are integral, and wherein said ceramic material has a bending strength of 200 MPa or more at a temperature of 1000 to 1200° C.

5. A bullet-shaped plug for rolling a seamless steel pipe, the plug being used for punching a hole in a steel piece or adjusting an inner diameter or an outer diameter of a punched raw pipe, the plug comprising:

an extremity end part;

a work part;

a reeling part; and a parallel part, wherein at least a surface layer of the extremity end part and at least a surface layer of the work part are made of ceramic material, the surface layer of the extremity end part being at least 3 mm thick, wherein the extremity end part, the work part and the reeling part are integral, and wherein said ceramic material has a bending strength of 200 MPa or more at a temperature of 800° C.

6. A method for manufacturing a seamless steel pipe, comprising:

providing, in a piercing machine, a plug comprising an extremity end part, a work part, a reeling part and a parallel part, at least a surface layer of the extremity end part and at least a surface layer of the work part being made of ceramic material, the surface layer of the extremity end part being at least 3 mm thick and the extremity end part. the work part and the reeling part being integral; and punching and rolling a steel piece with said plug.

7. A method for manufacturing a seamless steel pipe, comprising:

providing, in one of an elongating machine, a reel machine and a plug mill, a plug comprising an extremity end part, a work part, a reeling part and a parallel part, at least a surface layer of the extremity end part and at least a surface layer of the work part being made of ceramic material, the surface layer of the extremity end part being at least 3 mm thick and the extremity end part, the work part and the reeling part being integral; and rolling raw pipe by said plug.

* * * * *

UNITED STATES PATENT AND TRADEMARK OFFICE

CERTIFICATE OF CORRECTION

PATENT NO. : 6,202,463 B1
DATED : March 20, 2001
INVENTOR(S) : Akira Yorifuji, Takaaki Toyooka; Taro Kanayama It is certified that error appears in the above-identified patent and that said Letters Patent is hereby corrected as shown below:

Title page,
Change item [54] to read as follows:
-- [54] PLUG AND MANDREL BAR FOR SEAMLESS STEEL PIPE ROLLING OPERATION AND METHOD FOR MANUFACTURING SEAMLESS STEEL PIPE --

Signed and Sealed this

Fourth Day of December, 2001

*Attest:*

Nicholas P. Godici

NICHOLAS P. GODICI
*Acting Director of the United States Patent and Trademark Office*

*Attesting Officer*